US006779503B2

(12) United States Patent
Rado

(10) Patent No.: US 6,779,503 B2
(45) Date of Patent: Aug. 24, 2004

(54) AUTOMATIC ENGINE PRIMING SYSTEM FOR ROTARY MOWERS

(75) Inventor: Gordon E. Rado, Brookfield, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/287,105

(22) Filed: Nov. 4, 2002

(65) Prior Publication Data

US 2004/0084003 A1 May 6, 2004

(51) Int. Cl.[7] ..... F02M 1/10

(52) U.S. Cl. ..... 123/179.11; 261/36.2; 261/DIG. 8

(58) Field of Search ..... 123/179.11, 179.13; 261/36.2, DIG. 8

(56) References Cited

U.S. PATENT DOCUMENTS

| | | | | |
|---|---|---|---|---|
| 1,544,306 A | | 6/1925 | Franzen | |
| 2,063,087 A | | 12/1936 | FitzGerald | 123/119 |
| 2,293,792 A | | 8/1942 | Ball | 261/34 |
| 2,793,634 A | | 5/1957 | Ericson | 123/179 |
| 2,949,102 A | | 8/1960 | Arkus-Duntov | 123/119 |
| 3,246,886 A | | 4/1966 | Goodyear et al. | 261/39 |
| 3,587,553 A | | 6/1971 | Sutton | 123/180 E |
| 3,620,202 A | | 11/1971 | Ross | 123/179 G |
| 3,695,591 A | | 10/1972 | Caisley | 261/39 D |
| 3,872,851 A | | 3/1975 | Matsumoto et al. | 123/180 R |
| 4,194,483 A | | 3/1980 | McChesney et al. | 123/187.5 R |
| 4,311,129 A | | 1/1982 | Kakizaki et al. | 123/588 |
| 4,455,811 A | | 6/1984 | Beugelsdyk | 56/10.8 |
| 4,803,963 A | | 2/1989 | Kleinhans | 123/187.5 R |
| 4,814,114 A | | 3/1989 | Charmley | 261/35 |
| 4,905,641 A | * | 3/1990 | Miller | 123/179.13 |
| 5,355,662 A | | 10/1994 | Schmidt | 56/11.3 |
| 5,701,967 A | | 12/1997 | Barnard | 180/19.3 |
| 5,750,056 A | | 5/1998 | Pitman et al. | 261/37 |
| 5,803,035 A | | 9/1998 | Guntly | 123/179.11 |
| 6,029,619 A | | 2/2000 | Mitchell | 123/179.11 |

* cited by examiner

*Primary Examiner*—Andrew M. Dolinar
(74) *Attorney, Agent, or Firm*—Baker & Daniels

(57) ABSTRACT

A priming system for a carburetor for small internal combustion engines, wherein the priming system is remotely actuated and includes an automatic primer disabling feature operative when the engine is in a warm condition to prevent the supply of an overly rich fuel/air mixture to the engine intake system during warm re-starts, for example.

26 Claims, 3 Drawing Sheets

AUTOMATIC ENGINE PRIMING SYSTEM FOR ROTARY MOWERS

BACKGROUND OF THE INVENTION

1. Field of the Invention

The present invention relates to small internal combustion engines of the type used for lawn mowers, lawn and garden tractors, snow throwers and other implements, or with small sport vehicles. Particularly, the present invention relates to a priming system to aid in starting such engines.

2. Description of the Related Art

Small internal combustion engines typically include a carburetor which mixes liquid fuel with atmospheric air drawn through the carburetor to provide an air/fuel combustion mixture to the engine. One type of carburetor commonly used in small engines includes a throat with a venturi through which air is drawn, and into which fuel is drawn for mixing with the intake air. A fuel bowl is disposed beneath the throat in which a quantity of liquid fuel is stored. A float valve in the fuel bowl meters the supply of fuel thereinto from the main fuel tank as necessary as the fuel in the fuel bowl is consumed.

Additionally, such carburetors typically include a manually operable priming feature, such as a flexible priming bulb which is depressed by an operator to pressurize the air space above the fuel in the fuel bowl, thereby forcing a quantity of priming fuel into the carburetor throat for mixing with the intake air which is drawn into the carburetor. The priming fuel is in excess of the amount of fuel which is normally supplied for mixing with the intake air to form a combustion mixture, such that rich air/fuel mixture is initially supplied to the engine to aid in engine starting. After the engine starts, the priming fuel is consumed, and mixing of the air/fuel mixture is thereafter controlled by the fuel metering system of the carburetor during running of the engine.

The foregoing priming feature for carburetors requires an operator to manually press the flexible priming bulb at the location of the carburetor in order to prime the engine. Although remote priming devices which utilize a cable operably connected between the handle of an implement and the flexible priming bulb of the carburetor have been devised, such devices typically require multiple actuations thereof by an operator in order to build sufficient air pressure within the carburetor bowl to properly pressurize same.

Additionally, actuation of such priming mechanisms when the engine is already in a warm condition, such as during warm engine re-starts, may provide an unnecessarily rich fuel/air mixture to the engine which could flood the engine.

It is desirable to provide a priming system for use in small internal combustion engines having carburetors which is an improvement over the foregoing.

SUMMARY OF THE INVENTION

The present invention provides a priming system for a carburetor for small internal combustion engines, wherein the priming system is remotely actuated and includes an automatic primer disabling feature operative when the engine is in a warm condition to prevent the supply of an overly rich fuel/air mixture to the engine intake system during warm re-starts, for example.

A bail assembly on the implement with which the engine is used is connected via cable linkage to a rotatable cam member of the carburetor. When the bail is actuated prior to starting the engine, translation of the cable rotates the cam member to engage a cam surface thereof with a plunger of the carburetor to depress the plunger. Depression of the plunger forces a quantity of fuel from a priming chamber, defined between the plunger and the carburetor body, into the throat of the carburetor to provide a rich fuel/air mixture for engine priming.

After an initial quantity of fuel is forced from the priming chamber into the throat of the carburetor, a further quantity of fuel remains within the priming chamber and is gradually drawn into the throat of the carburetor during an initial running period of the engine to provide an enriched air/fuel mixture to the engine until the priming chamber is empty of liquid fuel. In this manner, the present priming system provides an initial amount of fuel for engine starting, and also provides an extended priming feature.

Additionally, the present priming system includes a thermally-responsive element operable during warm engine temperatures to disable the priming function. Specifically, a disk is rotatably mounted to the carburetor body within the priming chamber, and a thermally responsive element, such a bimetallic spring, is connected between the disk and the carburetor body. When the engine is cold, the bimetallic spring positions the disk in a first position wherein an opening in the disk is aligned with the priming passage connecting the priming chamber to the throat of the carburetor, such that liquid fuel may be forced therethrough for priming. Additionally, in the first disk position, a flap valve portion of the disk is aligned with a fuel supply passage which connects the fuel bowl to the priming chamber, and acts as a check valve such that when the plunger is depressed, fuel may only be forced through the priming passage to the throat of the carburetor.

When the engine reaches a warm operating temperature, the bimetallic spring rotates the disk to a second position in which the aperture thereof is not aligned with the priming passage and supply of priming fuel from the priming chamber through the priming passage to the throat of the carburetor is blocked to thereby disable the priming function. Also, in the second disk position, the flap valve portion of the disk is not aligned with the fuel supply passage, such that fuel may pass between the fuel bowl and the priming chamber.

The bimetallic spring is adjustably connected to the disk in order to vary the point of connection therebetween. In this manner, the disablement of the priming function can be properly correlated to an engine temperature at which is desired to disable the priming function.

Advantageously, the present invention provides a remotely-actuated priming system, eliminating the need for an operator to prime the carburetor at the location of the carburetor. Further, the thermally-responsive element is actuated at warm engine temperatures to disable the priming function, such that the engine cannot be primed during warm re-starts and flooding of the engine is less likely.

In one form thereof, the present invention provides an internal combustion engine, including an engine housing; a carburetor attached to the engine housing, the carburetor having a throat; a plunger moveably connected to the carburetor, the plunger and the carburetor defining a variable-volume priming chamber therebetween in which a quantity of liquid fuel is disposed; a plunger actuator moveably coupled to the plunger; and a thermally-responsive element disposed within the priming chamber, the element moveable between a first position in which the priming chamber is in fluid communication with the throat and a second position in which fluid communication between the priming chamber and the throat is blocked; whereby when the element is in the first position, movement of the plunger actuator moves the plunger to force at least a portion of the liquid fuel from the priming chamber into the throat.

In another form thereof, the present invention provides an internal combustion engine, including an engine housing; a carburetor attached to the engine housing, the carburetor having a throat; a plunger connected to the carburetor, the carburetor and plunger defining a priming chamber therebetween in which a quantity of liquid fuel is disposed; remotely actuable means for depressing the plunger to force at least a portion of the liquid fuel from the priming chamber into the throat; and thermally-responsive means disposed within the priming chamber for preventing injection of liquid fuel from the priming chamber into the throat when the engine is in a warm condition.

In a further form thereof, the present invention provides an implement, including a frame having a handle; a bail assembly attached to the handle; an engine connected to the frame and including a carburetor, the carburetor including a housing having a throat therethrough; a plunger connected to the housing and defining a priming chamber therebetween in which a quantity of liquid fuel is disposed, the plunger depressible by actuation of the bail assembly to force at least a portion of the liquid fuel from the priming chamber into the throat; and a thermally-responsive element moveable between a first position in which the priming chamber is in fluid communication with the throat and a second position in which fluid communication between the priming chamber and the throat is blocked.

In a further form thereof, the present invention provides a method of operating an implement having an internal combustion engine with a carburetor, including the steps of actuating a bail assembly of the implement which is connected to a plunger of the carburetor; depressing the plunger by actuation of the bail assembly to reduce the volume of a priming chamber defined between the plunger and a housing portion of the carburetor in which a quantity of liquid fuel is disposed; forcing at least a portion of the liquid fuel from the priming chamber into a throat of the carburetor to prime the carburetor; starting the engine; and disabling the priming of the carburetor by preventing passage of fuel from the priming chamber into the throat of the carburetor when the engine reaches a warm operating temperature.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention any manner.

DETAILED DESCRIPTION

Figure 1:
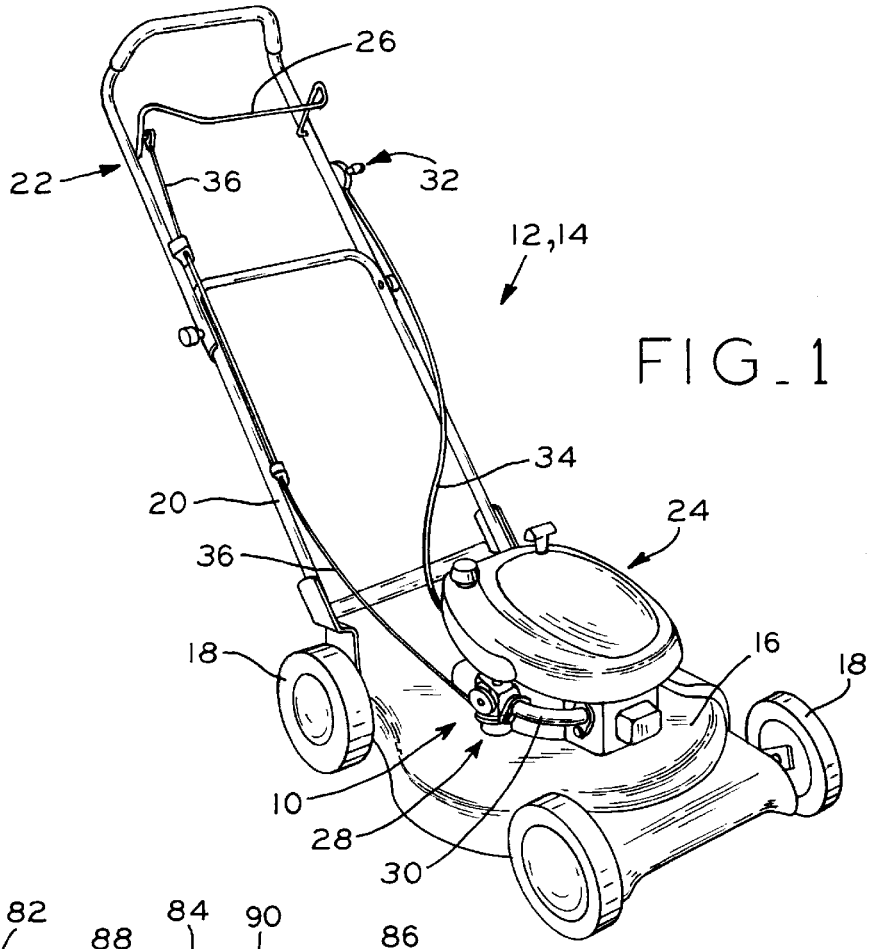
FIG. 1 is a perspective view of an exemplary implement, shown as a lawnmower having an internal combustion engine, and a carburetor incorporating the priming system of the present invention.

Referring to FIG. 1, automatic priming system 10 of the present invention is shown in connection with the engine of implement 12. Implement 12 is shown as a lawnmower 14; however, automatic priming system 10 may be used with small internal combustion engines of various other implements, such as snow throwers and tillers, for example. Lawnmower 14 generally includes deck 16 having wheels 18, handle 20 operably attached to deck 16, and bail assembly 22 mounted to handle 20. Additionally, lawnmower 14 includes internal combustion engine 24 mounted to deck 16, wherein the power take-off (PTO) end of the engine crankshaft (not shown) is disposed vertically, and extends beneath deck 16 for driving connection to a blade (not shown). Engine 24 may be of any suitable type, such as an overhead valve (OHV) engine, an overhead cam (OHC) engine, or a side valve or L-head engine, for example.

Bail assembly 22 includes bail 26, which may be operatively attached to the ignition system of the engine via suitable linkage (not shown), such that bail 26 must be actuated by an operator in order to start the engine, and wherein release of bail 26 during engine running interrupts the engine ignition resulting in engine shut-down. Additionally, release of bail 26 may also actuate an engine braking mechanism to stop the rotation of the blade of lawnmower 14 upon engine shut-down.

Engine 24 includes carburetor 28 for supplying an air/fuel mixture to the intake port of engine 24 via intake manifold 30. Throttle control 32 is operably attached to carburetor 28 via cable 34 to provide an operator-controlled speed input to carburetor 28. Bail 26 of bail assembly 22 is also attached to carburetor 28 via cable 36, wherein actuation of bail 26 in turn actuates priming system 10 of the present invention, as explained further below.

Figure 2:
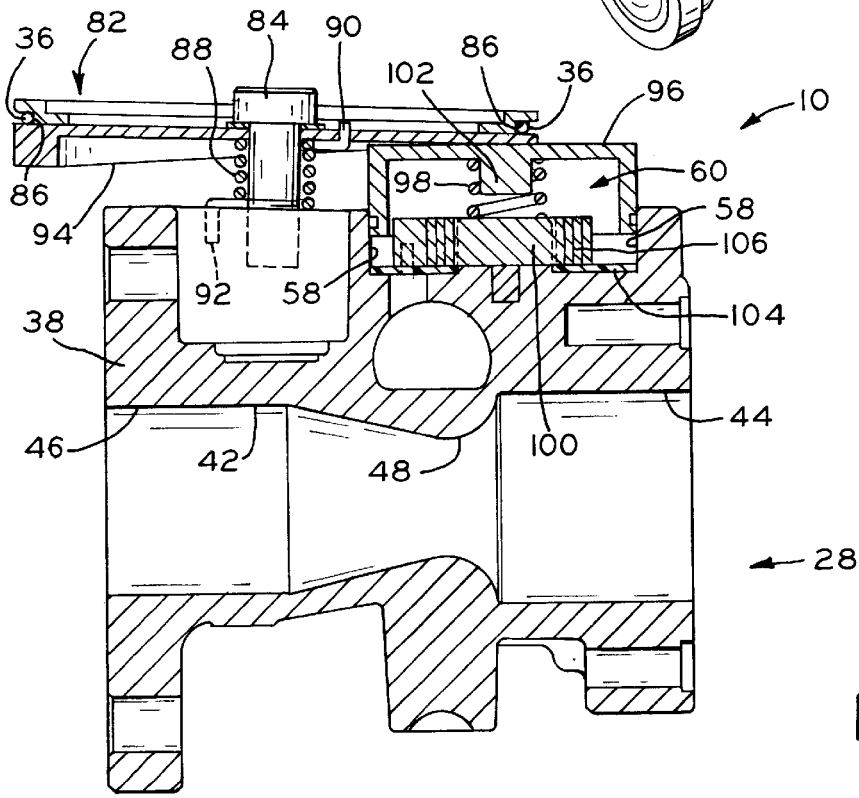
FIG. 2 is a horizontal sectional view through a portion of the body of the carburetor which is attached to the engine of the implement of FIG. 1.
Figure 5:
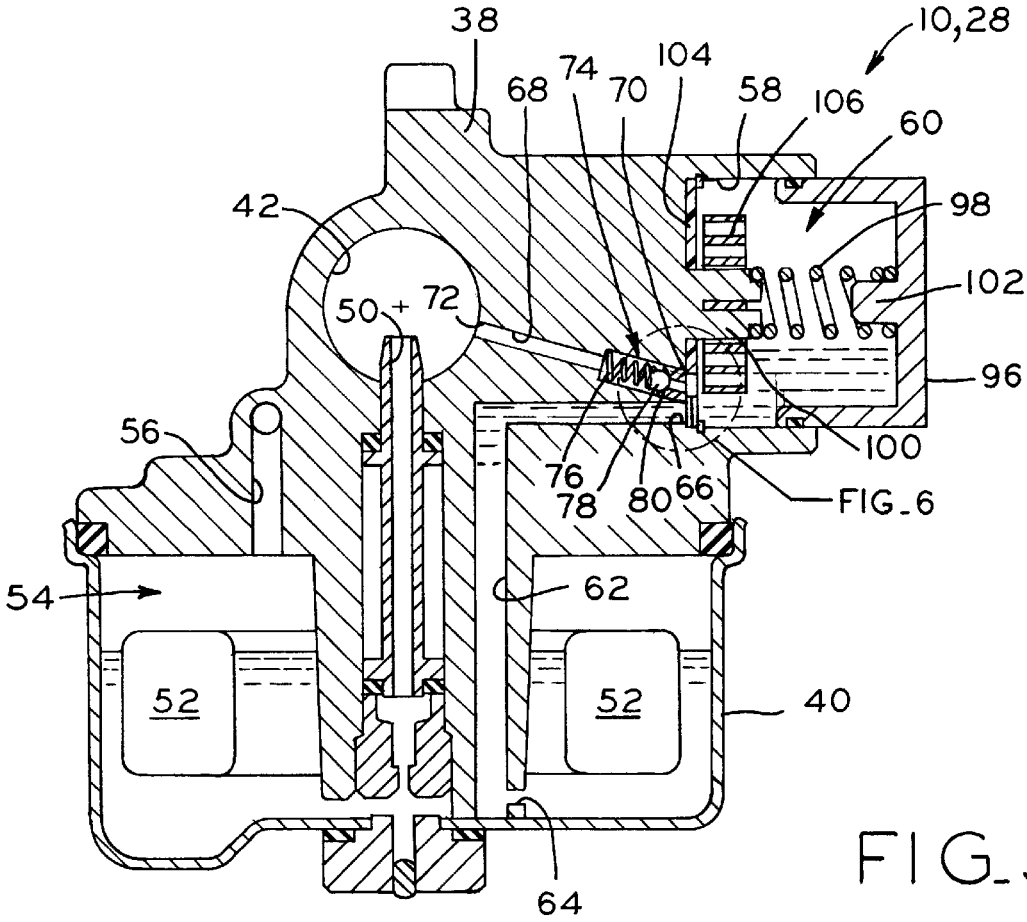
FIG. 5 is a vertical sectional view through the body of the carburetor, showing the disk in a first rotational position.

Referring to FIGS. 2 and 5, carburetor 28 generally includes carburetor body 38 and fuel bowl 40 attached to carburetor body 38. Carburetor 28 includes many features similar to the carburetor disclosed in U.S. Pat. No. 6,152,431, assigned to the assignee of the present invention, the disclosure of which is expressly incorporated herein by reference. Carburetor body 38 includes throat 42 disposed therethrough, which includes inlet end 44 and outlet end 46 and venturi portion 48 defined therebetween. Referring to FIG. 5, main fuel jet 50 extends from fuel bowl 40 into throat 42 to supply fuel into throat 42 in response to vacuum created at venturi portion 48 of throat 42 during running of engine 24. Fuel bowl 40 includes a quantity of fuel therein, and also includes float 52 which floats on the fuel within fuel bowl 40 and periodically actuates a valve (not shown) for metering a supply of fuel into fuel bowl 40 from a separate fuel tank (not shown). Air space 54 is defined within fuel bowl 40 above the fuel therewithin, and is vented to the atmosphere via internal vent passage 56, which is connected to inlet end 44 of throat 42.

Carburetor body 38 additionally includes annular recess 58 which forms a portion of priming chamber 60, as described further below. Referring to FIG. 5, fuel supply passage 62 connects fuel bowl 40 to priming chamber 60, and includes inlet 64 disposed beneath the level of fuel in fuel bowl 40, and outlet 66 opening into priming chamber 60. Priming chamber 60 is further connected to throat 42 via priming passage 68 having inlet 70 in communication with priming chamber 60, and outlet 72 opening into throat 42 of carburetor 28. Check valve 74 is disposed within priming passage 68, and generally includes spring 76, which biases ball 78 against seat 80 such that check valve is operable to allow passage of fuel from priming chamber 60 to throat 42 of carburetor 28, and to prevent passage of air or fuel from throat 42 to priming chamber 60.

Referring to FIG. 2, cam member 82 is rotatably mounted to carburetor body 38 in a suitable manner, such as upon stub shaft 84 extending from carburetor body 38. Cam member 82 is shaped similar to a pulley, and includes annular groove 86 therearound for receiving cable 36, an end of which is attached to cam member 82. An opposite end of cable 36 is attached to bail 26, as shown in FIG. 1. Return spring 88, shown as a torsional spring in FIG. 2, includes a first end 90 connected to carburetor body 38 and second end 92 connected to cam member 82. Movement of bail 26 toward the upper end of handle 20 translates cable 36 to rotate cam member 82 upon stub shaft 84 against the bias of return spring 88. Cam member 82 further includes a sloped cam surface 94 proximate plunger 96.

Figure 3:
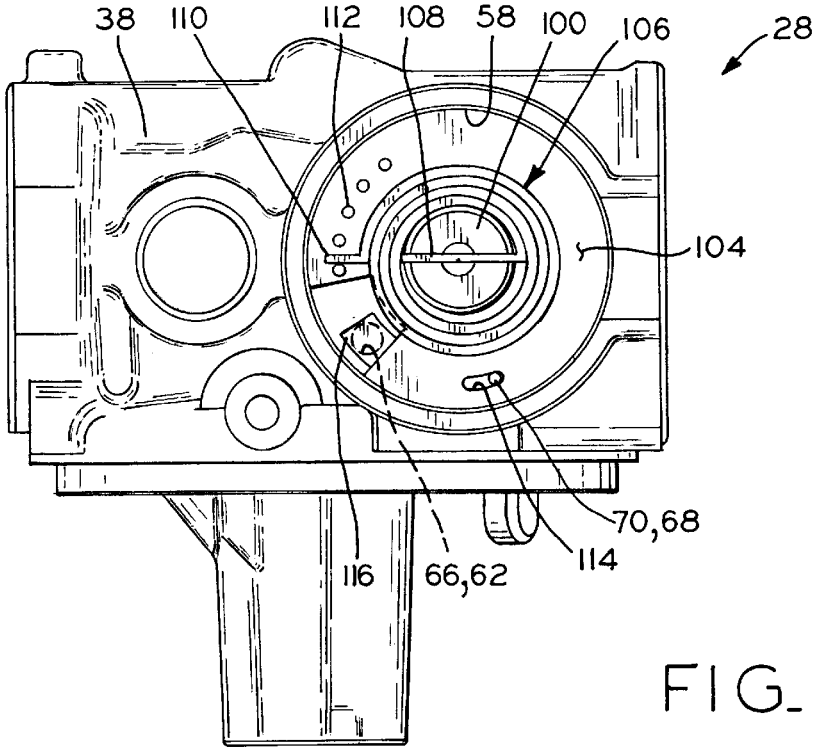
FIG. 3 is a first side elevational view of a portion of the carburetor, with the disk shown in a first rotational position corresponding to a cold engine temperature.

Plunger 96 is slidably mounted with respect to annular recess 58 of carburetor body 38, and comprises a rigid cup-shaped member made from a suitable metal or plastic, for example. Plunger 96 and annular recess 58 together define priming chamber 60 therebetween. Referring to FIGS. 2 and 3, return spring 98 is captured under compression between a boss 100 projecting centrally within annular recess 58 of carburetor body 38 and stub 102 projecting from an interior surface of plunger 96. Referring to FIG. 2, rotation of cam member 82, as described above, rotates cam surface 94 thereof into engagement with plunger 96 to force plunger 96 inwardly toward carburetor body 38 against the bias of return spring 98 to reduce the volume of priming chamber 60, as described in further detail below.

Figure 4:
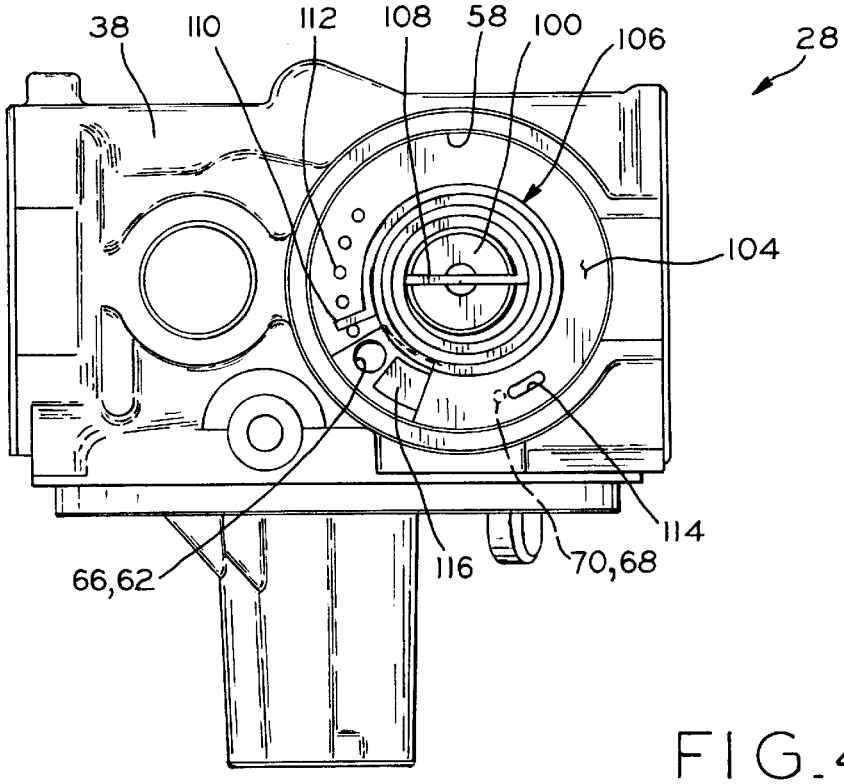
FIG. 4 is a second side elevational view of a portion of the carburetor, showing the disk in a second rotational position corresponding to a warm engine temperature.

Referring to FIGS. 2–6, a thermally-responsive element, disposed within priming chamber 60, generally includes disk 104 and bimetallic spring 106. Disk 104 is best shown in FIGS. 3 and 4, and generally includes a flat annular plate made of a suitable metal or plastic, for example, which is rotatably mounted around boss 100 of carburetor body 38. As shown in FIGS. 3 and 4, bimetallic spring or coil 106 is formed in two layers from materials having differing coefficients of thermal expansion, such that bimetallic spring contracts or expands based upon changes in temperature. Bimetallic spring 106 is coiled about boss 100 of carburetor body 38, and includes first end 108 fixedly attached to boss 100, and second end 110 attached to disk 104 via engagement of second end 108 between a pair of adjacent adjustment pins 112 within a plurality same which extend from disk 104.

Disk 104 additionally includes slot 114 and valve element 116. In a first rotational position of disk 104 shown in FIGS. 3 and 5, slot 114 is aligned with inlet 70 of priming passage 68, and flexible valve element 116 is disposed above outlet 66 of fuel supply passage 62. In this position, valve element 116 may flex away from outlet 66 to allow passage of fuel from fuel supply passage 62 into priming chamber 60, but seats against outlet 66 to prevent passage of fuel from priming chamber 60 through fuel supply passage 62. In a second rotational position of disk 104 shown in FIGS. 4 and 6, slot 114 of disk 104 is misaligned with inlet 70 of priming passage 68 such that disk 104 blocks inlet 70 of priming passage 68, and valve element 116 of disk 104 is misaligned with outlet 66 of fuel supply passage 62 such that priming chamber 60 is in communication with fuel bowl 40 through fuel supply passage 62.

The operation of priming system 10 will now be explained. When engine 24 is in a cold condition before starting, an initial quantity of fuel is disposed within priming chamber 60, as shown in FIG. 5, and plunger 96 is biased to its outward position by return spring 98. Additionally, bimetallic spring 116 is also in a cold state, and positions disk 104 in the first rotational position shown in FIG. 3, in which slot 114 of disk 104 is aligned with inlet 70 of priming passage 68, and valve portion 116 of disk 104 covers outlet 66 of fuel supply passage 62.

Referring to FIGS. 1 and 2, an operator primes the engine by actuating bail assembly 24, in which the operator manually moves bail 26 toward the upper portion of handle 20, thereby translating cable 36 and rotating cam member 82. Rotation of cam member 82 against the bias of return spring 88 rotates cam surface 94 thereof into contact with plunger 96, forcing plunger 96 inwardly toward carburetor body 38 against the bias return spring 98. As plunger 96 is forced inwardly, the volume of priming chamber 60 is decreased, and a metered amount of fuel within priming chamber 60 is forced through slot 114 in disk 104 and through priming passage 68 and check valve 74 into throat 42 of carburetor 28, where the fuel is mixed with intake air drawn through throat 42 to form a rich air/fuel mixture to aid in starting engine 24. Concurrently, fuel within priming chamber 60 is prevented from exiting priming chamber 60 through fuel supply passage 62, which is covered by valve portion 116 of disk 104 seated against outlet 66 of fuel supply passage 62.

After engine 24 starts, the operator will usually maintain bail 26 in the actuated position such as, for example, if bail assembly 22 is operatively connected to the ignition system of engine 24. Therefore, cam member 82 will maintain plunger 96 in a depressed condition during running of engine 24. Further, after engine 24 is initially started, a quantity of fuel, which is not forced through priming passage 68 into throat 42, remains within priming chamber 60 and is prevented from exiting priming chamber 60 due to the positioning of valve portion 116 of disk 104 over outlet 66 of fuel supply passage 62. The vacuum within throat 42 of carburetor 28 gradually draws this remaining quantity of fuel within priming chamber 60 through priming passage 68 and check valve 74 into throat 42 until the amount of fuel within priming chamber 60 is exhausted, or until the priming function is terminated by rotation of disk 104, as described below. In this manner, priming chamber 60 not only supplies an initial amount of liquid fuel for engine priming upon starting of engine 24, but also supplies a further amount of priming fuel during an initial warm-up period after engine 24 starts for extended priming of engine 24.

Figure 6:
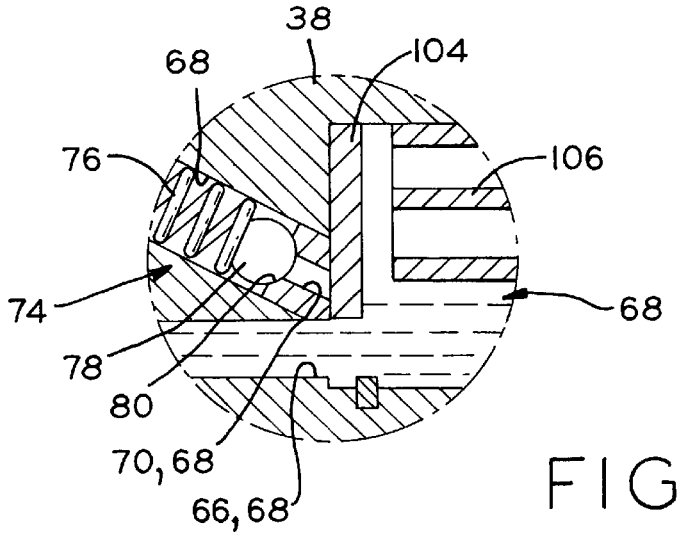
FIG. 6 is a fragmentary view of a portion of the carburetor of FIG. 5, showing the disk in a second rotational position.

After engine 24 is started and the temperature thereof increases through a warm-up period, bimetallic spring 106 rotates disk 104 to its second rotational position shown in FIGS. 4 and 6. Rotation of disk 104 moves slot 114 into a misligned position with respect to inlet 70 of priming passage 68, such that priming passage 68 is blocked by disk 104 and fuel is prevented from passing through priming passage 68 to throat 42 of carburetor 28, thereby terminating the priming function. Additionally, rotation of disk 104 to the position shown in FIGS. 4 and 6 moves valve element 116 away from outlet 66 of fuel supply passage 62 such that any remaining liquid fuel within priming chamber 60 may drain back into fuel bowl 40 as necessary. Therefore, the priming function of priming system 10 is disabled when engine 24 reaches a warm operating temperature.

Selective fitting of end 110 of bimetallic spring 106 between different adjacent pairs of adjustment pins 112 of disk 104 varies the connection point between bimetallic spring 106 and disk 104. By varying the connection point between bimetallic spring 106 and disk 104, the movement characteristics of disk 104 with respect to the temperature-controlled movement of bimetallic spring 106 may be adjusted. In this manner, the timed point during warm-up of engine 24 at which the priming function is disabled can be adjusted as needed, depending upon the particular operating characteristics of the engine with which carburetor 28 with priming system 10 is used, which operating characteristics may vary between engines of different types.

Notably, if an operator actuates bail 26 of bail assembly 22 when engine 24 is in a warm condition, such as during a warm re-start of engine 24, movement of plunger 96 against return spring 98 forces any fuel within priming chamber 60 back through outlet 66 of fuel supply passage into fuel bowl 40. Concurrently, fuel supply passage 68 is blocked by disk 104 in a warm engine condition, as described above, such that any fuel within priming chamber 60 is prevented from being forced through priming passage 68 into throat 42 of carburetor 28. Therefore, flooding of engine 24 by supplying an overly rich fuel/air mixture is prevented when engine 24 is in a warm condition.

When engine 24 is shut down and bail 26 of bail assembly 22 is released, movement of plunger 96 outwardly of carburetor body 38 by return spring 98 increases the volume of priming chamber 60. Check valve 74 prevents air from entering priming chamber 60 from throat 42 through priming passage 68 and, because inlet 64 of fuel supply passage 62 is disposed below the level of fuel within fuel bowl 40, fuel is drawn through fuel supply passage 62 from fuel bowl 40 into priming chamber 60. After engine 24 cools, disk 104 is rotated by bimetallic spring back to its first position shown in FIG. 3, such that priming system 10 is effectively re-charged for a subsequent priming operation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A carburetor, comprising:

a carburetor body having a throat;

a movable primer element connected to said carburetor, said primer element and said carburetor defining a variable-volume priming chamber therebetween in which liquid fuel is disposed;

a thermally-responsive element disposed between said priming chamber and said throat, said thermally-responsive element moveable between a first position corresponding to cold temperatures in which said priming chamber is in fluid communication with said throat and a second position corresponding to warm temperatures in which said thermally-responsive element prevents fluid communication between said priming chamber and said throat; said thermally responsive element comprising:

a movable member movable between said first and second positions; and a bimetallic element connected to said movable member, said bimetallic element having a cold temperature position corresponding to said movable member being in said first position and a warm temperature position corresponding to said movable member being in said second position;

whereby when said thermally-responsive element is in said first position, movement of said primer element forces at least a portion of said liquid fuel from said priming chamber into said throat.

2. The carburetor of claim 1, wherein said primer element comprises a piston member slidably connected to said carburetor body.

3. The carburetor of claim 2, further comprising a return spring connected between said carburetor body and said piston member, said return spring biasing said piston member away from said carburetor body.

4. The carburetor of claim 1, wherein said bimetallic element comprises a bimetallic spring.

5. The carburetor of claim 4, wherein said bimetallic spring is adjustably coupled to said movable member, whereby the tension of said bimetallic spring may be adjusted.

6. The carburetor of claim 1, wherein said movable member comprises a rotatable disk disposed within said priming chamber.

7. The engine of claim 1, wherein said carburetor includes a passage connecting said priming chamber and said throat, and said movable member includes an opening which is aligned with said passage in said first position.

8. The engine of claim 1, wherein said carburetor includes a passage connecting said priming chamber and said throat, said passage including a check valve therein which allows passage of fluid from said priming chamber to said throat but prevents passage of fluid from said throat to said priming chamber.

9. The carburetor of claim 1, wherein said carburetor further includes a fuel bowl connected to said priming chamber, and said movable member further comprises:

a valve element, wherein in said first position, said valve element allows passage of fuel from said fuel bowl to said priming chamber but prevents passage of fuel from said priming chamber to said fuel bowl, and in said second position, said valve element allows passage of fuel both from said fuel bowl to said priming chamber and from said priming chamber to said fuel bowl.

10. A carburetor, comprising:

a carburetor body having a throat;

a movable primer element connected to said carburetor body and defining a variable volume priming chamber therebetween in which liquid fuel is disposed; and thermally-responsive means disposed within said priming chamber for allowing passage of fuel from said priming chamber into said throat at cold temperatures upon movement of said primer element, and for preventing passage of fuel from said priming chamber into said throat at warm temperatures; said thermally-responsive means comprising:

a movable member; and a bimetallic element connected to said movable member, said bimetallic element positioning said movable member in a first position at cold temperatures to allow passage of fuel from said priming chamber into said carburetor throat upon movement of said primer element, said bimetallic element positioning said movable member in a second position at warm temperatures in which said movable member prevents passage of fuel from said priming chamber into said carburetor throat.

11. The carburetor of claim 10, wherein said primer element comprises a piston member slidably connected to said carburetor body.

12. The carburetor of claim 10, further comprising a remotely actuable primer actuator connected to said primer element.

13. The carburetor of claim 12, wherein said primer actuator comprises:

a cam member rotatably mounted to said carburetor and having a cam surface disposed proximate said primer element, whereby rotation of said cam member engages said cam surface with said primer element to depress said primer element.

14. An internal combustion engine, comprising:

an engine housing;

a carburetor attached to said engine housing, said carburetor having a throat;

a movable primer element connected to said carburetor, said primer element and said carburetor defining a variable volume priming chamber therebetween in which liquid fuel is disposed; and a thermally-responsive element disposed between said priming chamber and said throat, said thermally-responsive element movable between a first position corresponding to cold engine temperatures in which said priming chamber is in fluid communication with said throat and a second position corresponding to warm engine temperatures in which said movable member prevents fluid communication between said priming chamber and said throat;

said thermally responsive element comprising:

a movable member having an aperture therein, said movable member movable between said first and second positions; and a bimetallic element connected to said movable member, said bimetallic element having a cold temperature position corresponding to said movable member being in said first position and a warm temperature position corresponding to said movable member being in said second position;

whereby when said thermally-responsive element is in said first position, movement of said primer element forces at least a portion of said liquid fuel from said priming chamber into said throat, and when said thermally-responsive element is in said second position, flow of fuel from said priming chamber to said throat is blocked.

15. The engine of claim 14, wherein said primer element comprises a piston member slidably connected to said carburetor body.

16. The engine of claim 14, wherein said carburetor further includes a fuel bowl connected to said priming chamber, and said movable member further comprises:

a valve element, wherein in said first position, said valve element allows passage of fuel from said fuel bowl into said priming chamber but prevents passage of fuel from said priming chamber into said fuel bowl, and in said second position, said valve element allows passage of fuel both from said fuel bowl into said priming chamber and from said priming chamber into said fuel bowl.

17. The implement of claim 14, wherein said carburetor includes a passage connecting said priming chamber to said throat, said passage including a check valve therein which allows passage of fluid from said priming chamber to said throat but prevents passage of fluid from said throat to said priming chamber.

18. The engine of claim 14, further comprising:

an operator-controlled bail assembly;

a cam member rotatably mounted to said carburetor and having a cam surface disposed proximate said primer element; and linkage connecting said bail assembly and said cam member, wherein actuation of said bail assembly translates said linkage to rotate said cam member, engaging said cam surface with said primer element to depress said primer element.

19. The engine of claim 14, wherein said quantity of fuel disposed within said priming chamber is greater than said amount which is forced into said throat such that, after the engine is started, at least a further portion of said quantity of fuel is drawn from said priming chamber into said throat to provide an enriched fuel/air mixture.

20. A method of operating an implement having an internal combustion engine having a carburetor, comprising the steps of:

depressing a primer element to reduce the volume of a priming chamber in which liquid fuel is disposed; thereby forcing at least a portion of the liquid fuel from the priming chamber into a throat of the carburetor to prime the carburetor;

starting the engine; and automatically disabling priming of the carburetor when the engine reaches a warm operating temperature by heating a thermally-responsive sensor element mechanically linked to a movable member to position the movable member in blocking relation with the passage of fuel from the priming chamber into the throat of the carburetor.

21. The method of claim 20, wherein said depressing step further comprises actuating an implement handle mounted bail assembly associated with the engine to depress said primer actuator.

22. A carburetor, comprising:

a carburetor body having a throat;

a movable primer element connected to said carburetor body, said primer element and said carburetor body defining a variable-volume priming chamber therebetween in which liquid fuel is disposed; and a thermally-responsive sensor element connected to said carburetor body, said sensor element mechanically linked to a movable member disposed between said priming chamber and said throat, said sensor element positioning said movable member in a first position corresponding to cold temperatures in which said priming chamber is in fluid communication with said throat, and positioning said movable member in a second position corresponding to warm temperatures in which said movable member prevents fluid communication between said priming chamber and said throat;

whereby when said movable member is in said first position, movement of said primer element forces at least a portion of said liquid fuel from said priming chamber into said throat.

23. The carburetor of claim 22, wherein said primer element comprises a piston member slidably connected to said carburetor body.

24. The carburetor of claim 23, further comprising a return spring connected between said carburetor body and said piston member, said return spring biasing said piston member away from said carburetor body.

25. The carburetor of claim 22, wherein said sensor element is a bimetallic element.

26. The carburetor of claim 22, wherein said movable member comprises a rotatable disk disposed within said priming chamber.

* * * * *